United States Patent [19]

Beggs et al.

[11] Patent Number: 4,755,629

[45] Date of Patent: Jul. 5, 1988

[54] LOCAL AREA NETWORK CABLE

[75] Inventors: Richard D. Beggs, Duluth; Harold W. Friesen, Dunwoody; David M. Mitchell, Dunwoody; Wendell G. Nutt, Dunwoody; Palmer D. Thomas, Tucker, all of Ga.

[73] Assignees: AT&T Technologies, Berkeley Heights; AT&T Bell Laboratories, Murray Hill, both of N.J.

[21] Appl. No.: 910,848

[22] Filed: Sep. 24, 1986

Related U.S. Application Data

[63] Continuation-in-part of Ser. No. 780,859, Sep. 27, 1985.

[51] Int. Cl.[4] ..... H01B 11/02

[52] U.S. Cl. ..... 174/34; 174/36; 174/115

[58] Field of Search ..... 174/32, 34, 36, 115

[56] References Cited

U.S. PATENT DOCUMENTS

| | | | |
|---|---|---|---|
| 2,623,093 | 12/1952 | Smith | 174/115 |
| 3,209,064 | 9/1965 | Cutler | 174/36 |
| 3,489,844 | 1/1970 | Motley | 174/34 |
| 3,546,357 | 12/1970 | MacPherson et al. . | |
| 3,644,659 | 2/1972 | Campbell | 174/34 X |
| 3,927,247 | 12/1975 | Timmons | 174/36 |
| 4,058,669 | 11/1977 | Nutt et al. . | |
| 4,096,346 | 6/1978 | Stine et al. | 174/36 |
| 4,153,332 | 5/1979 | Longoni . | |
| 4,412,094 | 10/1983 | Dougherty et al. | 174/34 X |
| 4,468,089 | 8/1984 | Brorein | 174/36 X |
| 4,533,790 | 8/1985 | Johnston et al. . | |

FOREIGN PATENT DOCUMENTS

| | | | |
|---|---|---|---|
| 100222 | 2/1937 | Australia | 174/36 |

*Primary Examiner*—Morris H. Nimmo

*Attorney, Agent, or Firm*—Edward W. Somers

[57] ABSTRACT

A cable (20) which is particularly suited to the transmission of substantially error-free data at relatively high rates over relatively long distances includes at least two pairs of individually insulated conductors (42—43). Each pair of individually insulated conductors is enclosed individually in its own tubular member (51) comprising a plastic material. A metallic shield (60) encloses the tubular members, and in a preferred embodiment, a plastic jacket (80) encloses the shield. In the preferred embodiment, two pairs of voice communications conductors are disposed at opposed locations between the shield and the jacket. The thickness of the tubular member is such that each insulated conductor of each twisted pair is caused to be spaced from the shield a distance which is not less than one half the diameter of the metallic wire portion of each pair enclosed by the tubular member.

19 Claims, 5 Drawing Sheets

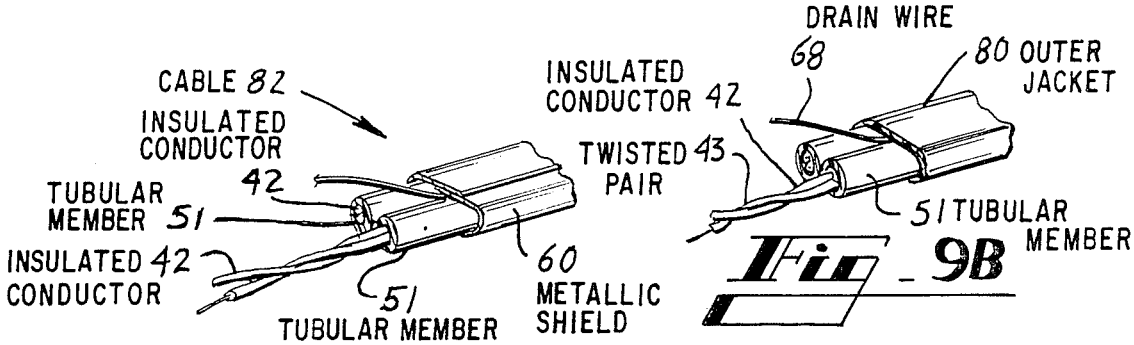
Fig. 9A
Fig. 9B
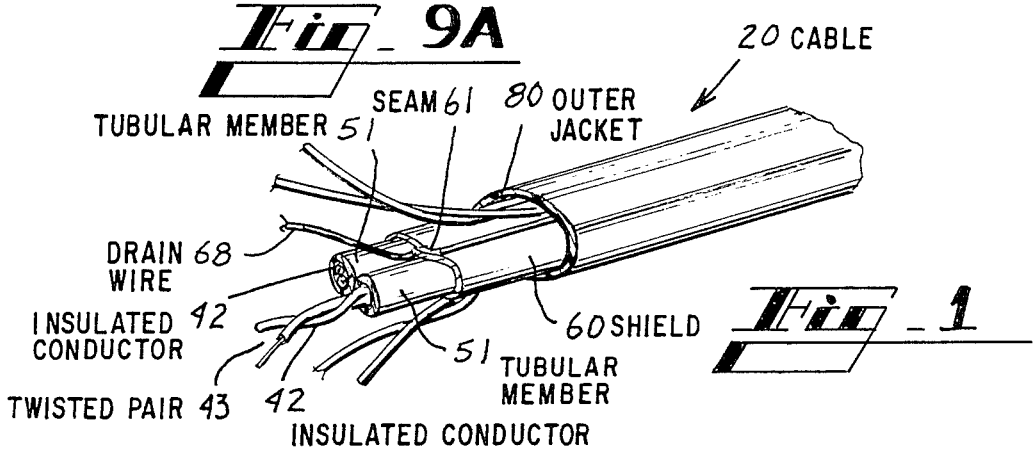
Fig. 1
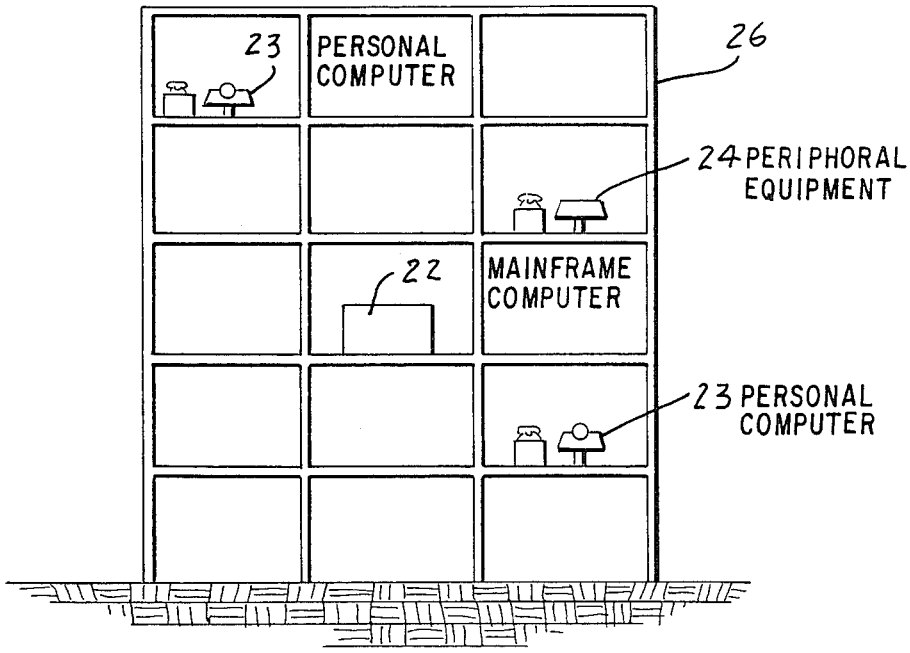
Fig. 2

LOCAL AREA NETWORK CABLE

This application is a continuation-in-part of application Ser. No. 780,859 filed Sept. 27, 1985.

TECHNICAL FIELD

This invention relates to a local area network cable. More particularly, it relates to a cable which is capable of providing substantially error-free data transmission at relatively high rates over relatively long distances.

BACKGROUND OF THE INVENTION

Along with the greatly increased use of computers for offices and for manufacturing facilities, there has developed a need for a cable which may be used to connect peripheral equipment to mainframe computers and to connect two or more computers into a common network. A number of factors must be considered in order to arrive at a cable design which is readily marketable for such uses.

Cable connectorability is very important and is more readily accomplished with twisted insulated conductor pairs than with any other medium. A widely used connector for insulated conductors is one which is referred to as a split beam connector. See, for example, U.S. Pat. No. 3,798,587 which issued on Mar. 19, 1974 in the names of B. C. Ellis, Jr. et al. Desirably, the outer diameter of insulated conductors of the sought-after cable is sufficiently small so that the conductors can be terminated with such existing connector systems.

The jacket of the sought-after cable should exhibit low friction to enhance the pulling of the cable into ducts or over supports. Also, the cable should be strong, flexible and crush-resistant, and it should be conveniently packaged and not unduly weighty. Because the cable may be used in occupied building spaces, flame retardance also is important.

To satisfy present, as well as future needs, the sought-after cable should be capable of suitable high frequency data transmission. This requires a tractable loss for the distance to be covered, and crosstalk and electromagnetic interference (EMI) performance that will permit substantially error-free transmission. Also, the cable must not contaminate the environment with electromagnetic interference.

The sought-after data transmission cable should be low in cost. It must be capable of being economically installed and be efficient in terms of space required. Generally, for cables in buildings, which are used for such interconnection, installation costs outweigh the cable material costs. Building cables should have a relatively small cross-section inasmuch as small cables not only enhance installation but are easier to conceal, require less space in ducts and wiring closets and reduce the size of associated connector hardware. At the same time, however, peripheral connection arrangements must meet attenuation and crosstalk requirements.

Another cost consideration is whether or not the system is arranged to provide transmission in what is called a balanced mode. In balanced mode transmission, voltages and currents on the conductors of a pair are equal in amplitude but opposite in polarity. This requires the use of additional components, such as transformers, for example, at end points of the cable between the cable and logic devices thereby increasing the cost of the system. Generally, computer equipment manufacturers have preferred the use of systems characterized by an unbalanced mode because most of the industry is not amenable to investing in additional components for each line. In an unbalanced mode transmission system, voltages and currents on the conductors of a pair are not characterized by equality of amplitude and opposition of polarity. However, given other advantages of a balanced system such as, for example, less crosstalk particularly at longer distances, computer equipment manufacturers may be inclined to install such a system.

Of importance to the design of local area network copper conductor cables are the speed and the distances over which data signals must be transmitted. In the past, this need has been one for interconnections operating at data speeds up to 20 kilobits per second and over a distance not exceeding about 150 feet. This need has been satisfied in the prior art with single jacket cables which may comprise a plurality of insulated conductors that are connected directly between a computer, for example, and receiving means such as peripheral equipment. Additional components at the ends of each pair to convert to the balanced mode have not been used.

In today's world, however, it becomes necessary to transmit data signals at much higher speeds over distances which may include several thousands of feet. Both the data rates and the distances for transmission may be affected significantly by the topology of some presently used local area network arrangements. In one, for example, each of a plurality of terminal stations is connected to a common bus configured in a ring such that signals generated at one station and destined for another must be routed into the wiring closet and seriatim out to each station intermediate the sending and receiving stations. The common bus, of course, requires a very high data rate to serve a multiplicity of stations and the ring configuration doubles the path length over which the data signals must be transmitted from each station to the wiring closet.

Even at these greatly increased distances, the transmission must be substantially error-free and at relatively high rates. Often, this need has been filled with coaxial cable comprising the well-known center solid and outer tubular conductor separated by a dielectric material. The use of coaxial cables, which inherently provide unbalanced transmission, presents several problems. Coaxial connectors are expensive and difficult to install and connect, and, unless they are well designed, installed and maintained, can be the cause of electromagnetic interference. Of course, the use of coaxial cables does not require components such as transformers at each end to provide balanced mode transmission, but the size and connectorization of coaxial cables outweigh this advantage.

Shielding often is added to a twisted pair of insulated conductors to confine its electric and magnetic fields. In this way, susceptibility to electromagnetic interference is reduced. However, as the electric and magnetic fields are confined, resistance, capacitance and inductance all change, each in such a way as to increase transmission loss. One company markets a cable in which each pair of conductors is provided with a shield and a braid is provided about the plurality of pairs. In order to compensate for the increased losses, the conductor insulation must be increased in thickness. As a result, the insulated conductors cannot be terminated with conventional connector hardware.

On the other hand, a cable shield surrounding all conductor pairs in a cable may be advantageous. Consider that the pairs may be inside a cabinet and may be exposed a high speed digital signals. Stray radiation will be picked up in the longitudinal mode of the twisted pairs. If the pairs are then routed outside the cabinet, they may radiate excessively. If there is a cable shield enclosing the plurality of pairs, the shield may be grounded at the cabinet wall so that the shield will not itself carry stray signals to the outside environment. Thus, a shield disposed about all the pairs in a cable can be effective in preventing electromagnetic interference and yet not increase appreciably the attenuation of each pair.

The sought after cable should be one that may be used to replace the well known D-inside wiring which comprises a plurality of twisted insulated conductor pairs. The pairs are non-shielded and are enclosed in a jacket. Improved pair isolation has long been sought in such wiring to reduce crosstalk. Hopefully, the cable of this invention also could be used for burglar alarm systems and for today's sophisticated thermostat systems, for example.

Seemingly, the solutions of the prior art to the problem of providing a local area network cable which can be used to transmit, for example, data bits error-free at relatively high rates over relatively long distances have not yet been totally satisfying. What is needed and what is not provided by the prior art is a cable which is compatible with balanced or unbalanced mode transmission equipment and which can be readily installed, fits easily into building architectures, and is safe and durable.

SUMMARY OF THE INVENTION

The foregoing problems have been overcome by a cable of this invention. The cable of the preferred embodiment of this invention is capable of high rate transmission of data streams and is capable of balanced or unbalanced mode transmission. The cable comprises a plurality of transmission media each of which includes a twisted pair of individually insulated conductors with each of the insulated conductors a metallic conductor and an insulation cover which encloses the metallic conductor. A buffer system includes a plurality of portions each of which comprises a dielectric material and each of which is associated individually with a pair of conductors. Each buffer portion encloses substantially the associated pair of insulated conductors and is effective to inhibit distortion of the twist configuration of the associated pair of conductors. As a result of the physical separation of the conductor pairs and the maintenance of the twist configuration of each pair, crosstalk performance is improved. Also, the cable of the preferred embodiment includes a sheath system which includes a shield that protects the cable against electromagnetic interference. The shield is a laminate which comprises a metallic material and a plastic film and encloses the plurality of transmission media which are used for data transmission. In a preferred embodiment, a jacket which is made of a plastic material encloses the shield. The thickness of each buffer portion is such that each insulated conductor of each pair is spaced from the shield by a distance which is equal at least to one half the diameter of the metallic portion of each insulated conductor enclosed by the buffer portion.

In a preferred embodiment, each of the conductors is enclosed with a dual insulation cover. The cover includes an inner layer of an expanded cellular material such as expanded polyethylene and an outer layer of a solid material such as polyvinyl chloride material. Also, included in the preferred embodiment are at least two pairs of insulated conductors which are used for voice communications. These are disposed between the metallic shield and the plastic jacket and are in generally diametrically opposite locations.

BRIEF DESCRIPTION OF THE DRAWINGS

Other features of the present invention will be more readily understood from the following detailed description of specific embodiments thereof when read in conjunction with the accompanying drawings, in which:

FIG. 1 is a perspective view of a cable of this invention for providing substantially error-free data transmission over relatively long distances;

FIG. 2 is an elevational view of a building to show a mainframe computer and printers linked by the cable of this invention;

FIGS. 9A–9B are perspective views of other embodiments of the cable of this invention.

DETAILED DESCRIPTION

Referring now to FIG. 1, there is shown a data transmission cable which is designated generally by the numeral 20. Typically the cable 20 may be used to network one or more mainframe computers 22—22, many personal computers 23—23, and peripheral equipment 24 on the same or different floors of a building 26 (see FIG. 2). The peripheral equipment 24 may include a high speed printer, for example. Desirably, the interconnection system minimizes interference on the system in order to provide substantially error-free transmission.

Figures 3, 4:
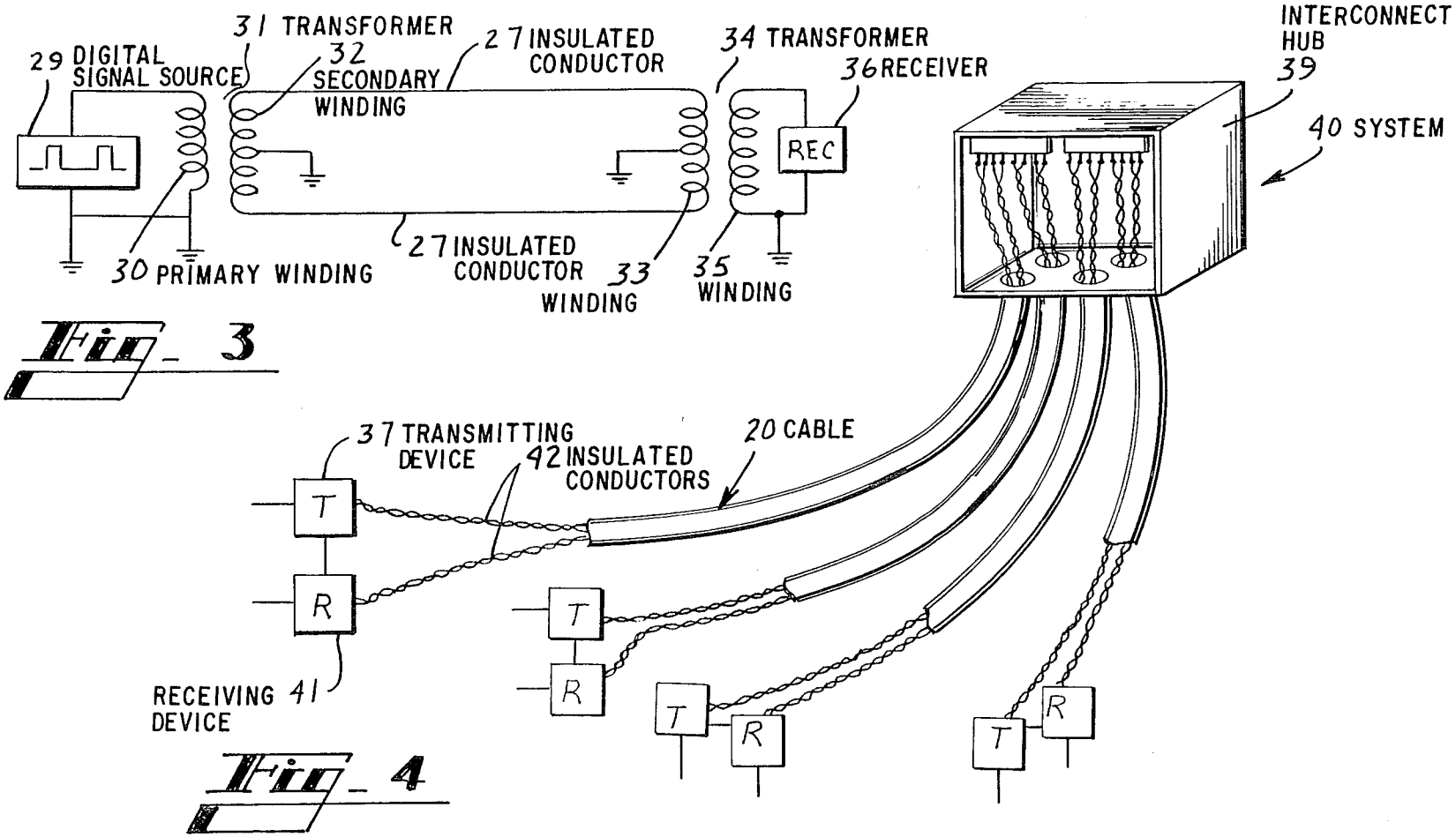
FIG. 3 is a schematic view of a pair of insulated conductors in an arrangement for balanced mode transmission.
FIG. 4 is a schematic view of a data transmission system which includes the cable of this invention.

The cable 20 of this invention is directed to providing substantially error-free data transmission in a balanced or in an unbalanced mode. A balanced mode prior art transmission system which includes a plurality of pairs of individually insulated conductors 27—27 is shown in FIG. 3. Each pair of conductors 27—27 is connected from a digital signal source 29 through a primary winding 30 of a transformer 31 to a secondary winding 32 which is center-tap grounded. The conductors are connected to a winding 33 of a transformer 34 at the receiving end which is also center-top grounded. A winding 35 of the transformer 34 is connected to a receiver 36. With regard to outside interference, whether it be from power induction or other radiated fields, the electric currents cancel out at the output end. If, for example, the system should experience an electromagnetic interference spike, both conductors will be affected equally, resulting in a null, with no change in the received signal. For unbalanced transmission, a shield may minimize these currents but cannot cancel them.

Computer equipment manufacturers frequently have not found it advisable to use balanced mode transmission, primarily because of costs. For unbalanced mode transmission, it is unnecessary to connect additional components such as transformers into circuit boards at the ends of each conductor pair. Use in an unbalanced mode avoids the need for additional terminus equipment and renders the cable 20 compatible with present equipment. However, because of the distances over which the cable of this invention is capable of transmitting data signals substantially error-free at relatively high rates, there may be a willingness to invest in the additional components at the ends of the cable which are required for balanced mode transmission.

Further, there is a requirement that the outer diameter of the cable 20 not exceed a predetermined value and that the flexibility of the cable be such that it can be installed easily. The cable 20 has a relatively small outer diameter and is both rugged and flexible thereby overcoming the many problems encountered when using a cable with individually shielded pairs.

Referring now to FIG. 4, there is shown a system 40 in which the cable 20 of this invention is useful. In FIG. 4, a transmitting device 37 at one station is connected along a pair of conductors 42—42 of one cable to an interconnect hub 39 and then back out along another cable to a receiving device 41 at another station. A plurality of the stations comprising transmitting devices 37—37 and receiving devices 41—41 are connected to the interconnect hub in what is referred to as a ring network. As can be seen, the conductors are routed from the transmitting device at one terminal to the hub 39 and out to the receiving device at another terminal, thereby doubling the transmission distance.

Figure 5:
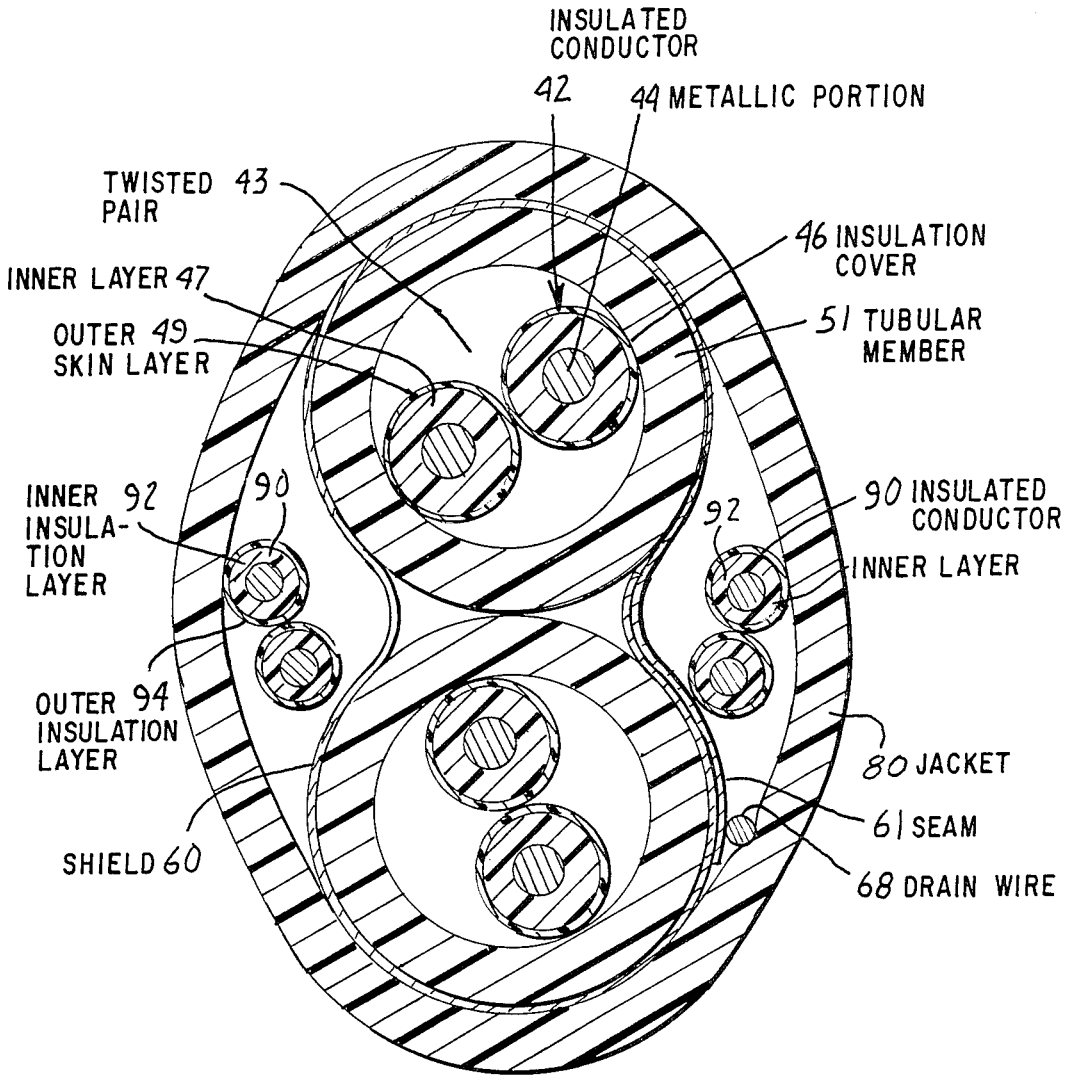
FIG. 5 is an end view in section of the cable of FIG. 1.

More particularly, the cable 20 of this invention includes a plurality of twisted pairs 43—43 of the individually insulated conductors 42—42 (see FIGS. 1 and 5). The twist length is generally less than 3 inches with the shortest being about 1.8 inches. In the embodiment as shown in FIGS. 1 and 5, the core comprises two pairs of individually insulated conductors 42—42 which are used for data transmission. Each of the conductors 42—42 includes a metallic portion 44 and an insulation cover 46. In a preferred embodiment which is shown in FIGS. 1 and 5, the insulation cover comprises an inner layer 47 of cellular material such as for example, expanded polyethylene and an outer skin layer 49 of a solid plastic material such as a polyvinyl chloride composition. In a preferred embodiment, the metallic conductor is 22 gauge copper, the thickness of the inner layer is about 0.018 inch and that of the outer layer is about 0.004 inch.

Each of the pairs of insulated conductors 42—42 is enclosed individually by a portion of a buffer system such as by a tubular member 51 (see FIGS. 1 and 5) which in a preferred embodiment comprises a polyvinyl chloride composition. The thickness of the tubular member 51 is equal at least to the radius of the metallic portion 44 of each insulated conductor of the pair enclosed by the tubular member. In this way, each of the pairs of individually insulated conductors is said to be belted or buffered. In an alternative embodiment, the tubular member comprises an expanded polyvinyl chloride plastic material. The thickness of the tubular member 51 in a preferred embodiment is about 0.030 inch.

Figure 6:
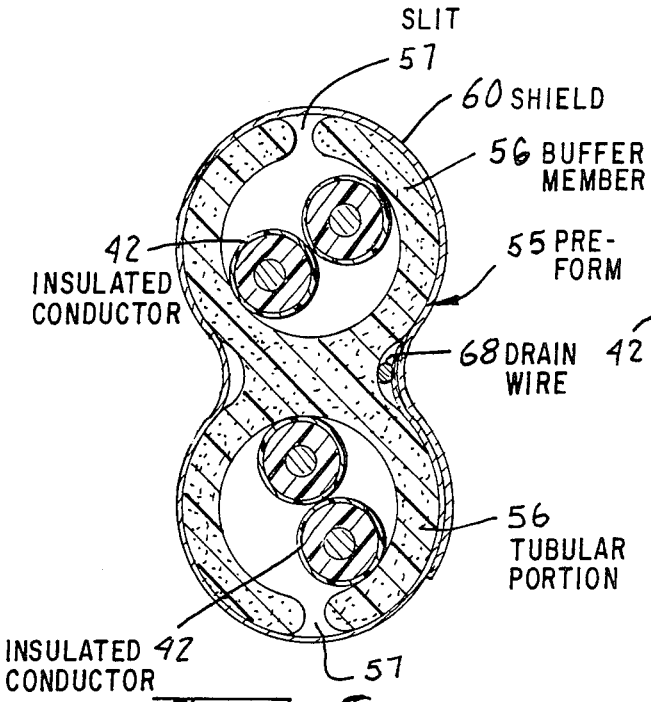
FIGS. 6 and 7 are end views in section of alternative embodiments of a portion of the cable of FIG. 5.
Figure 7:
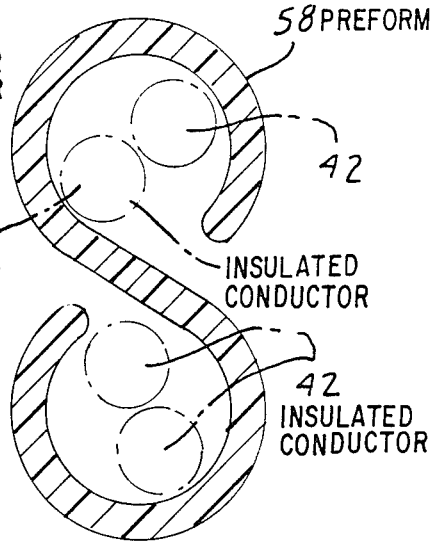

Other embodiments of the individual conductor pair buffering are shown in FIGS. 6 and 7. It is within the scope of this invention to replace the tubular members 51—51 with a preform 55 comprising dual tubular buffer portions or members 56—56 which are joined together (see FIG. 6). The preform may be comprised of a solid or expanded polyvinyl chloride plastic material. Further, the preform 55 is provided with a longitudinally extending slit 56 in each outer wall thereof. In this way, the preform 55 may be provided in a supply roll to a manufacturing line and a pair of the insulated conductors 42—42, twisted or untwisted, is caused to be inserted into each tubular portion 56 as the tubular portion is opened along its slit 57. In FIG. 7, on S-shaped preform 58 provides an individual buffer for each conductor pair. As in the preferred embodiment, the thickness of each portion of the preform is equal at least to the radius of the metallic portion of each insulated conductor enclosed by the buffer.

Figure 5A:
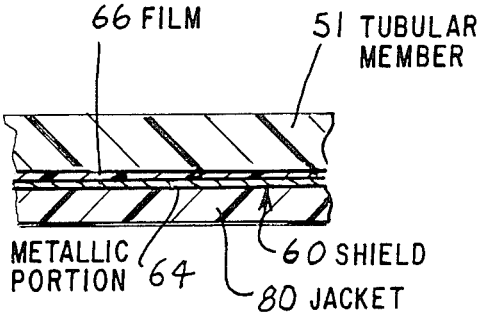
FIG. 5A is a detail view of a portion of the cable of FIG. 5.

Disposed about the plurality of belted pairs of individually insulated conductors is a shield 60 (see FIGS. 1 and 5) having an overlapped seam 61. The metallic shield 60 in a preferred embodiment is a laminate (see FIG. 5A) which comprises a metallic portion 64, such as an aluminum foil, and a plastic layer or film 66. Typically, the thickness of the metallic portion is about 0.002 inch while that of the plastic film is 0.001 inch. In the preferred embodiment, the metallic portion 64 faces outwardly.

A drain wire 68 also is included in the cable 20 in engagement with the metallic portion 64 of the shield 60. It may be disposed between the metallic shield 60 and one of the tubular members which covers a pair of individually insulated conductors. In the preferred embodiment, the metallic portion 64 of the shield faces outwardly and the drain wire 68 is disposed adjacent to the outer surface of the shield 60 so that the metallic portion is oriented toward and in engagement with the drain wire.

Each of the tubular 51—51 functions as a buffer which causes the individually insulated conductor pairs to be isolated from the shield 60 with respect to attenuation. Otherwise, the closer a pair of insulated conductors is to the metallic shield, the higher the attenuation. Because of the thickness of the buffer members 51—51, each insulated conductor of each twisted pair of conductors is separated from the metallic shield by a distance which is not less than one half the diameter of the wire which comprises the metallic portion 44 of each conductor. The tubular members or portions of the buffer system may take other forms as long as they comprise material having a relatively low dielectric constant. For example, each of the tubular members 51—51 may comprise material in strip form which is wrapped helically or longitudinally, for example, about its associated pair of individually insulated conductors 42—42. Also, the S-shaped preform 58 in FIG. 7 may be replaced with a tape which is made of a dielectric material and which is wrapped about the conductor pairs to cause each pair to be enclosed substantially in a dielectric portion of the buffer system.

Figure 8A:
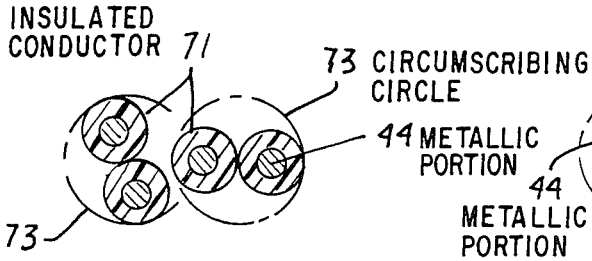
FIGS. 8A–8D are end views in section of prior art cables and the cable of this invention.

In the drawings, FIGS. 8A–8D depict the evolution of cable changes beginning with a conventional twisted pair cable and ending with the preferred embodiment of this invention. These views are intended to depict the changes with the conductor portions 44—44 being the same diameter in all the views, although the figures have been scaled differently for convenience of illustration. As can be imagined from a review of the drawings, the opportunity for the insulated conductors 42—42 of one pair to interlock physically with the conductors of an adjacent pair is negated. As is known, it is commonplace in packed cores for at least one individually insulated conductor 71 of one twisted pair to invade the space of another pair as defined by a circumscribing circle 73 (see FIG. 8A). Pair invasion also results, undesirably, in the distortion of the twist configurations, particularly those of longer twist lengths by conductors of pairs having shorter twist lengths. In FIG. 8A, the outer diameter of the insulated conductor, which is referred to as its diameter-over-dielectric (DOD), is equal about to the product of 1.7 and the diameter of a metallic conductor portion 44. For the pairs of individually insulated conductors which are shown in FIG. 8A, there is relatively high capacitance and low inductance. Transmission loss is proportional to the square root of the quotient of capacitance and inductance. Accordingly for a twisted pair of conductors having relatively thin wall insulation such as the pair shown in FIG. 8A, the loss is relatively high.

Figure 8B:
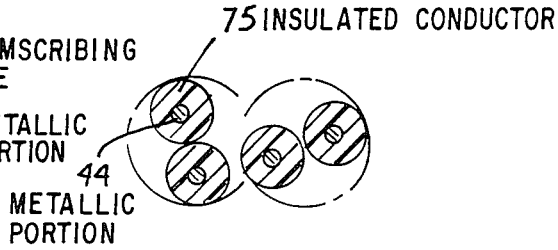
Figure 8C:
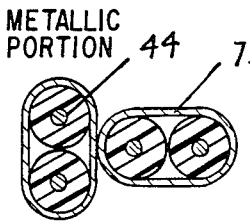

In FIG. 8B, there are shown insulation portions 75≦75 of a low capacitance cable with standard pair twists. The DOD of each insulated conductor 75 is equal about to the product of 4 and the diameter of the metallic conductor portion 44. For this cable, capacitance is reduced and inductance is increased, both of which reduce the loss. Surprisingly, resistance also is reduced, thereby further reducing the loss. However, the DOD is so large that the insulated conductors cannot be terminated with conventional connector hardware.

In each pair of conductors of the cable of FIG. 8B is confined in a metallic shield 79 (see FIG. 8C), the capacitance increases, there is no space sharing and as in a coaxial cable the transmission loss is higher. The shield is effective in terminating the field that otherwise would extend out from the conductors into the shared space. As such, a shield is very effective in retaining all the electromagnetic energy inside its periphery, but the transmission loss increases. Also, the DOD remains too large to facilitate termination with conventional connector hardware.

Figure 8D:
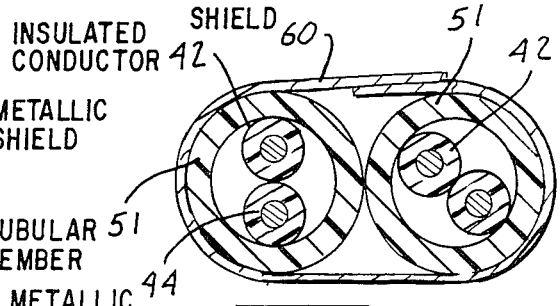

As should be apparent, the conductor pairs in FIG. 8D which are not individually shielded but which are individually buffered, share the electromagnetic space therebetween, but not the physical space of each pair as defined by the circumscribing circles. Neither conductor of one pair of the cable 20 of this invention invades the circled circumscribed space of another pair. In the cable 20, this results from the provision of an individual tube 51 for each conductor pair, which arrangement is shown schematically in FIG. 8D. The buffer or belt about each pair prevents the invasion of space of one pair by a conductor 42 of an adjacent pair.

The use of individual buffer portions such as tubular members 51—51 for each conductor pair results in lower attenuation and improved crosstalk performance. Each buffer portion functions to maintain a space between the associated conductor pair and the shield which reduces the excess loss which otherwise would be caused by the shield. The portions of the buffer system maintain the conductor pairs spaced apart which improves crosstalk performance, and inhibit distortion of the helical pair twists which further improves crosstalk performance.

The absence of individual pair shielding overcomes another objection to prior art cables. The insulation cover 46 about each metallic conductor is small enough so that the insulated conductor can be terminated with standard connector hardware. In FIG. 8D, the DOD of each insulated conductor is equal about to the product of 2.8 and the diameter of the metallic conductor 44. In one prior art local area network cable, each conductor pair is shielded and has a diameter-over-dielectric (DOD) of 0.096 inch. The belted pair of the cable of this invention has a DOD of 0.070 inch which is accepted by a conventional cross-connect panel, for example.

In a preferred embodiment, the cable 20 is provided with an outer jacket 80 (see FIGS. 1 and 5) which comprises a polyvinyl chloride material. Advantageously, the jacket material is fire-retardant. Further in a preferred embodiment, the thickness of the jacket 80 is in range of about 0.025 inch.

It is within the scope of this invention to provide a cable 82 (see FIG. 9A) which includes a plurality of the insulated conductors 42—42 with each pair enclosed individually with a tubular member 51 and a shield 60 but without the jacket 80. Of course, the jacket 80 of the preferred embodiment provides mechanical protection for the cable. It is also within the scope of this invention to enclose the buffer system with a jacket only (see FIG. 9B) should a shield not be needed such as in a replacement for D-inside wiring, or to bind together the individual buffer members. Of course, if the preform 55 or 58 is used, a binder may not be necessary.

For voice communications, the cable 20 may be provided with a plurality of pairs of individually insulated conductors 90—90 (see FIGS. 1 and 5). Each of the conductors 90—90 of each of the pairs includes an elongated metallic member such as 22 gauge wire, a solid polyethylene inner layer 92 of insulation and an outer 94 layer of insulation comprising polyvinyl chloride material.

When considering a combination high speed data and telephone wire pair, it is common knowledge that the maximum practical data rate on twisted copper pairs is about 1 Mb/s. Given the limited range required for building distribution systems, up to 10 Mb/s may be allowed for twisted pairs. Limitations usually involve crosstalk and, at times, EM1. Whatever the limitations imposed by these interferences, the impulse noise generated by the telephone switchhook operation can be 20 to 30 dB greater than the signal power in a data stream. Therefore, limitations imposed by crosstalk between two data streams are escalated 20 to 30 dB if telephone signals are placed in the same cable with no isolation therebetween.

It should be observed from the drawings, that, unlike the conductors 42—42 which are used for data transmission, the voice communication pairs of insulated conductors 90—90 are disposed between the metallic shield 60 and the outer jacket 80. This is done in order to prevent so-called impulse noise from interfering with data transmission. Also, as can be observed from the drawings, the voice communication pairs of insulated conductors 90—90 are diametrically opposed to each other. Again this provides better isolation for those pairs with respect to voice-to-voice and impulse noise-to-voice interference.

The transmitting device 37 of the system 40 (see FIG. 4) may include facilities for driving each pair of insulated conductors of the cable 20 in a balanced mode. These facilities include a balanced solid state driver, which is well known in the art, such as, for example, a transmit converter driving device designated 606 HM and manufactured by AT&T Technologies, Inc.

Futher the system 40 includes the receiving facilities 41 for detecting whether the level of the transmitting signal is above or below predetermined threshold values. The facilities 41 also may include a solid state balanced receiver device which is capable of receiving and converting signals into two or more logic levels. A typical receiving converter which is available commercially is one designated 630 AG and manufactured by AT&T Technologies, Inc. Unlike the balanced mode system described, an unbalanced system may include direct couple driving and receiving facilities, without any intermediate components for each pair between the conductors of the pair and the logic devices.

Although FIG. 4 depicts only one conductor pair extending between the driving facilities and the receiving facilities, it should be understood that all pairs of the cable extend therebetween. All conductor pairs may be connected to ports of one driving chip, for example. Further, one conductor of each pair may serve as a return conductor.

Figure 10:
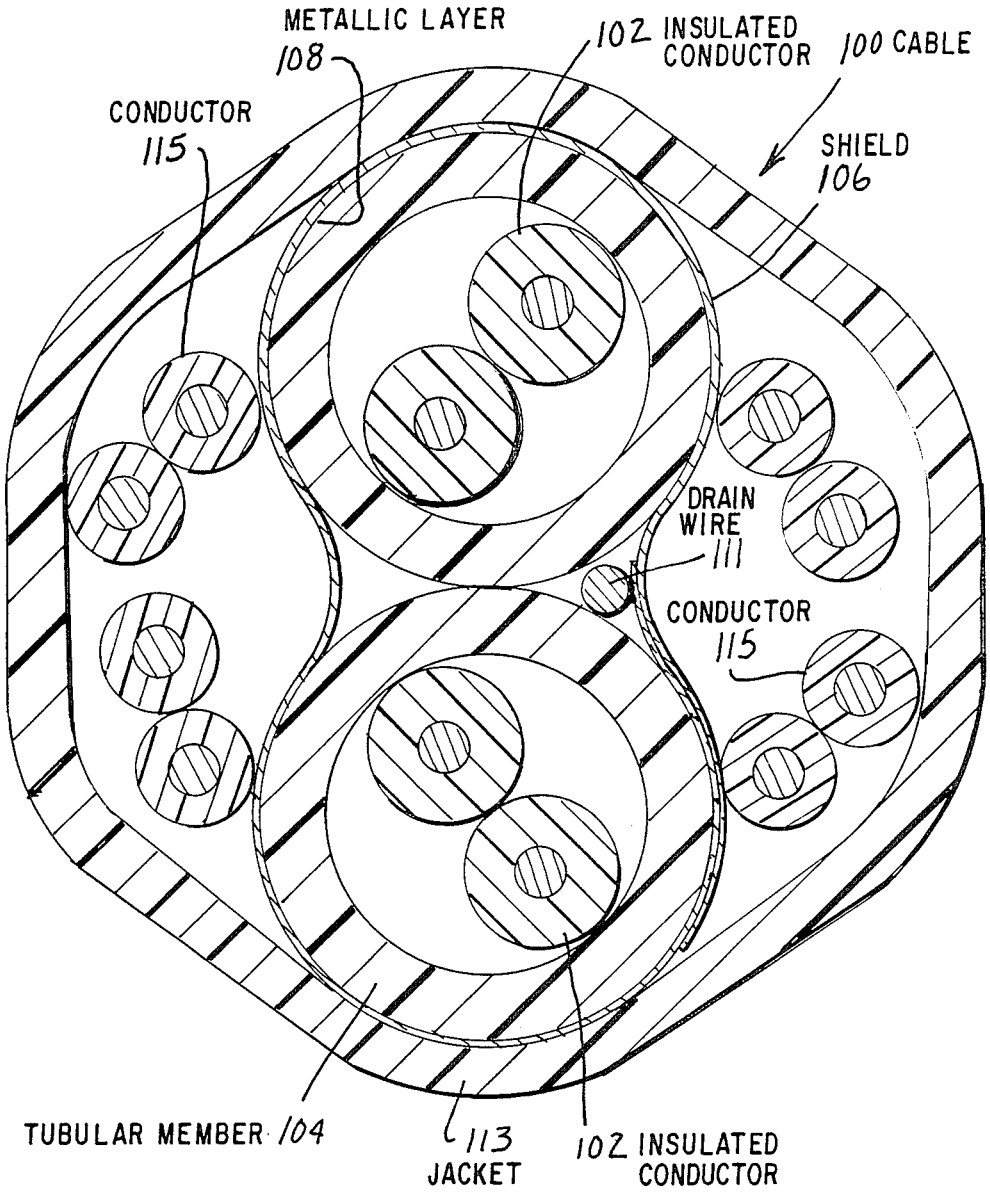
FIG. 10 is an end cross-sectional view of still another embodiment of the cable of this invention.

In FIG. 10, there is shown an alternative embodiment of the cable of this invention. A cable 100 includes two pairs of individually insulated conductors 102—102 with each pair being enclosed individually in a plastic tubular member 104. The tubular members 104—104 are enclosed in a laminated shield 106 which comprises an inner metallic layer 108 which engages a drain wire 111. A jacket 113 encloses the common shield 106. The cable 100 includes four pairs of voice communications conductors 115—115 with two pairs being disposed on each side of the cable to cause the cable to have a generally hexagonal shape.

It has been found that the losses experienced with the above described cable 20 are approximately the same as for non-shielded cable. Crosstalk performance of the cable 20 is somewhat less than for multiple coaxial cable, or in cables having individually shielded pairs, but it is acceptable in a cable which meets stringent size requirements.

The cable 20 of this invention provides for digital transmission a medium which is superior in its installability properties and in its resistance to electromagnetic interference. With the cable 20 of this invention, transmission needs up to about fifty megabits per second over each conductor pair over distances up to several thousands of feet have been achieved. Also, different pairs may be simultaneously transmitting signals all in the same direction or some pairs may transmit in one direction and others in the opposite direction. Further, the data streams on different pairs may be either synchronous or asynchronous.

It should be understood that the above described arrangements are simply illustrative of the invention. Other arrangements may be devised by those skilled in the art which will embody the principles of the invention and fall within the scope and spirit thereof.

What is claimed is:

1. A communications cable, which comprises:

a plurality of transmission media, each of which includes a twisted pair of individually insulated conductors with each of said insulated conductors comprising a metallic conductor and an insulation cover which encloses said metallic conductor;

a sheath system which includes at least a plastic jacket and which encloses said plurality of transmission media; and a buffer system which comprises a dielectric material and which includes a plurality of portions each of which is associated indivually with a pair of the conductors, each said portion enclosing substantially the associated pair of insulated conductors and being effective to inhibit distortion of the twist configuration of the associated pair of conductors, further each said portion having a thickness which is equal at least to the radius of the metallic conductor of an associated insulated conductor to space suitably each pair of insulated conductors from said sheath system.

2. The communications cable of claim 1, which also includes a shield comprising a metallic portion such that each buffer portion is disposed between its associated pair of insulated conductors and said shield.

3. The communications cable of claim 2, which also includes a jacket comprising a plastic material and enclosing said shield.

4. The communications cable of claim 3, wherein each said portion of said buffer system includes a tubular member.

5. The communications cable of claim 4, wherein the outer diameter of each of the insulated conductors is equal about to the product of two to three and the diameter of the metallic conductor.

6. The communications cable of claim 4, wherein said insulation cover includes an inner layer which comprises a cellular polyethylene material and an outer layer which comprises a solid polyvinyl chloride material.

7. The communications cable of claim 3, wherein said jacket comprises a polyvinyl chloride plastic material.

8. The communications cable of claim 3, which also includes at least two pairs of individually insulated conductors which are disposed between said shield and said jacket.

9. The communications cable of claim 8, wherein said pairs of conductors which are disposed between said shield and said jacket are generally diametrically opposite to each other.

10. The communications cable of claim 8, wherein an end section of the cable is generally hexagonally shaped.

11. The communications cable of claim 3, wherein said shield comprises an aluminum foil.

12. The communications cable of claim 3, wherein said shield is a laminate which comprises a metallic material and a plastic film.

13. The communications cable of claim 12, wherein said plastic film is made of a polyester plastic material.

14. The communications cable of claim 12, wherein said shield is disposed about the buffer system to cause the metallic material to be oriented outwardly toward said jacket.

15. The communications cable of claim 14, which also includes a drain wire which is disposed between the metallic material of said shield and said jacket and is in engagement with the metallic material.

16. The communications cable of claim 3, wherein the buffer portion for one conductor pair is connected together with a buffer portion for another conductor pair.

17. The communications cable of claim 16, wherein each of the buffer portions is provided with a longitudinally extending slit to provide access for the conductors into the buffer portions.

18. The communications cable of claim 16, wherein the buffer portions are portions of a tape which has been wrapped in an S-shape to enclose substantially the pairs of conductors.

19. The communications cable of claim 3, wherein said buffer system is comprised of a cellular polyvinyl chloride material.

* * * * *